United States Patent [19]

Sakai

[11] Patent Number: 4,750,017

[45] Date of Patent: Jun. 7, 1988

[54] COMPOSITE COPYING METHOD AND COLOR COPIER FOR PRACTICING THE SAME

[75] Inventor: Yoshihiro Sakai, Tokyo, Japan

[73] Assignee: Ricoh Company, Ltd., Tokyo, Japan

[21] Appl. No.: 893,774

[22] Filed: Aug. 6, 1986

[30] Foreign Application Priority Data

Aug. 13, 1985 [JP] Japan ..... 60-176949

[51] Int. Cl.[4] ..... G03G 15/01

[52] U.S. Cl. ..... 355/4; 355/3 SH; 355/3 R

[58] Field of Search ..... 355/4, 3 R, 3 SH, 14 SH, 355/14 R

[56] References Cited

U.S. PATENT DOCUMENTS

| | | | |
|---|---|---|---|
| 4,072,412 | 2/1978 | Suda et al. | 355/4 X |
| 4,095,879 | 6/1978 | Katayama et al. | 355/4 |
| 4,531,828 | 7/1985 | Hoshino | 355/4 X |

*Primary Examiner*—A. C. Prescott

*Attorney, Agent, or Firm*—Oblon, Fisher, Spivak, McClelland & Maier

[57] ABSTRACT

A composite copying method in full colors, a single color, two colors and black and white and a color copier for practicing the method are disclosed. While toner images of different colors are sequentially transferred onto a paper, the paper is retained by a support member. The timing at which the paper is to be separated from the support member is controllable from outside the copier.

7 Claims, 9 Drawing Sheets

COMPOSITE COPYING METHOD AND COLOR COPIER FOR PRACTICING THE SAME

BACKGROUND OF THE INVENTION

The present invention relates to a method of producing a composite copy and a color copier with a composite copying capability in addition to ordinary capabilities of full-color copying, single-color and two-color copying, and black-and-white copying.

Presently a full color copier capable of producing composite copies is not available. One possible approach to implement such a capability is copying a first document on a paper, accommodating the paper in an exclusive stacker or a stacker adapted for double-face copying, and re-feeding the paper to copy a second document thereon. This scheme, however, has a drawback that the stacker which is necessary for the paper to be accommodated increases the overall dimensions of the machine as well as costs.

SUMMARY OF THE INVENTION

It is therefore an object of the present invention to provide a color copier capable of producing composite copies as well as ordinary full-color copies, single- and two-color copies, and black-and-white copies.

It is another object of the present invention to provide a composite copying method which allows composite copies to be produced without resorting to a stacker.

It is another object of the present invention to provide a generally improved composite copying method and color copier for practicing the same.

In accordance with the present invention, there is provided a color copier capable of producing a composite copy, comprising at least one rotatable photoconductive element, an exposing device for exposing the photoconductive element imagewise via a filter device to provide on the photoconductive element a latent image which corresponds to an original document, a developing device comprising at least a yellow developing unit, a magenta developing unit and a cyan developing unit for developing the latent image with toners, a paper support member for supporting a paper such that toner images provided by the developing device on the photoconductive element are transferred onto a predetermined position on the paper superposed on and in register with each other, a paper separating device for separating the paper from the paper support member after completion of transfer of the toner images, and a control for controlling the paper separating device such that the paper is separated at any selected timing.

In accordance with the present invention, there is also provided a composite copying method for a color copier which is capable of selectively producing a single-color and full-color copies, comprising the steps of selecting a composite copy mode, setting a number of images to be combined with a first image on a single paper, and selecting one of fully-color copying and single-color copying.

The above and other objects, features and advantages of the present invention will become more apparent from the following detailed description taken with the accompanying drawings.

DESCRIPTION OF THE PREFERRED EMBODIMENTS

In one of full-color copiers known in the art, a blue, a green and a red color-separating filters are so arranged as to be selectively movable into an optical imaging path. Three developing units accommodating yellow, magenta and cyan toners, respectively, are located in a position downstream of an exposing station where a photoconductive drum is to be exposed imagewise. A transfer drum is held in contact with the photoconductive drum at a transferring station which is defined at the downstream side of the exposing station. The transfer drum is rotatable in the same direction and at the same peripheral speed as the photoconductive drum to wrap a paper electrostatically around the photoconductive drum. Every time the photoconductive drum completes one rotation, it is exposed imagewise with the color-separating filters switched from one to another. Each of the resultant latent images is developed by a particular one of the toners which is complementary in color to the filter, whereupon the toner image is transferred onto a paper and fixed thereon while being superposed on the others. This type of full-color copying system is generally referred to as a three-color separated image superposing transfer system.

Theoretically, a full-color copier of the type described is capable of reproducing all the possible colors inclusive of black if yellow, magenta and cyan are mixed in adequate proportions. However, when it comes to black-and-white copying, exposing the photoconductive drum three consecutive times through the filters and transferring images three consecutive times wastes a considerable quantity of light and time. In light of this, there has been proposed a color copier in which an extra developing unit adapted for the supply of black toner is disposed in the vicinity of a photoconductive drum. In this type of copier, in the event of black-and-white copying the photoconductive drum is exposed only once and without the intermediary of a filter so that the resultant latent image is developed by the black toner.

Figure 1:
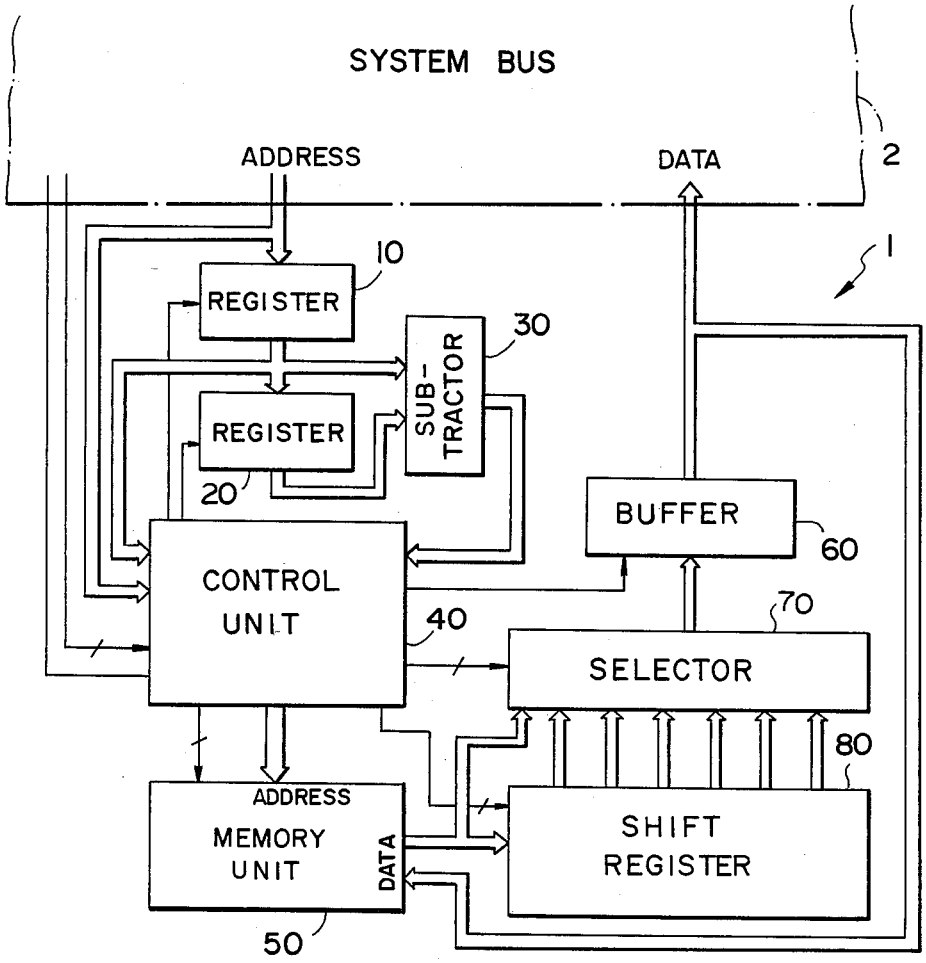
FIG. 1 is a fragmentary sectional side elevation of a color copier with which the composite copying method of the present invention may be practiced.
Figure 2A:
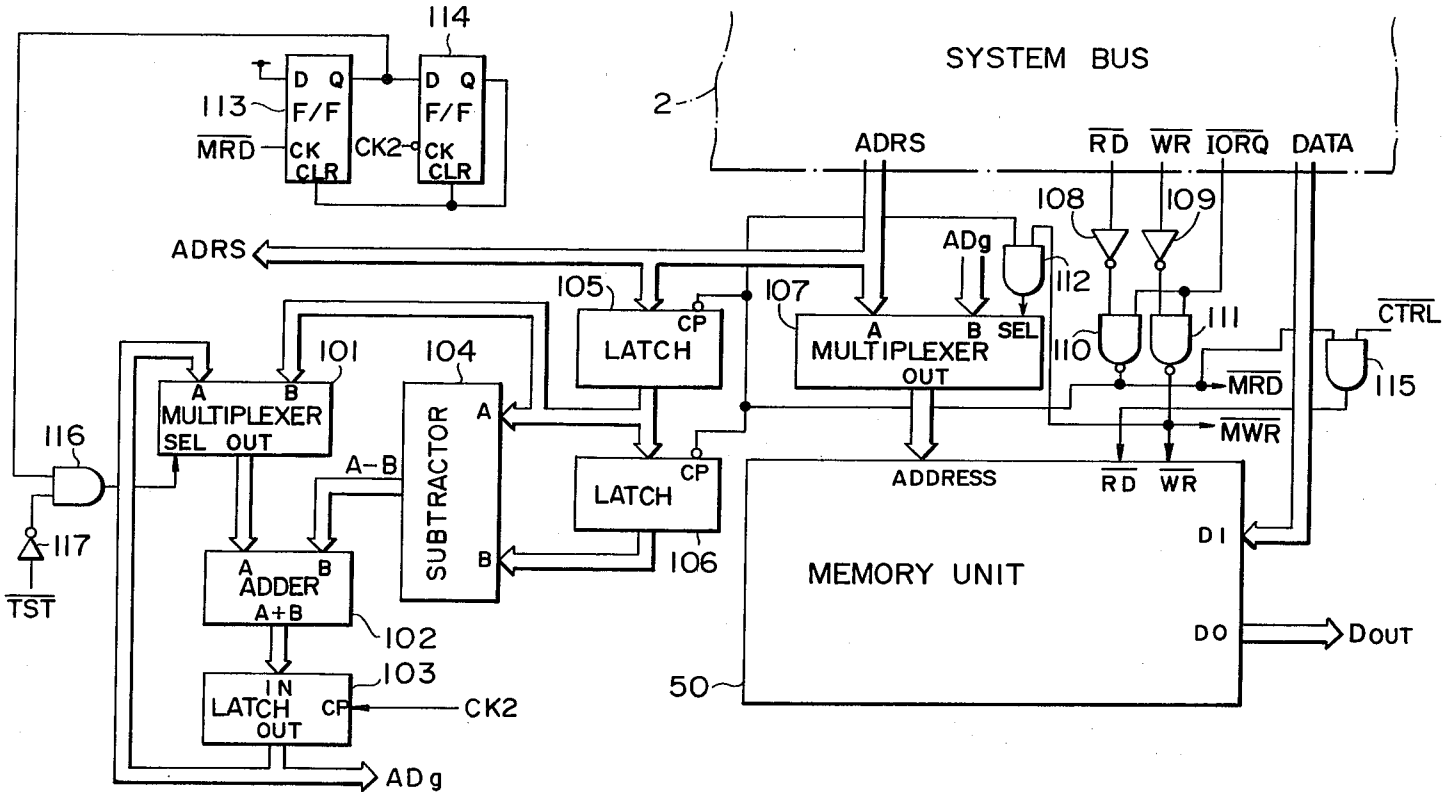
FIG. 2 is a block diagram showing a control system associated with the copier of FIG. 1.
Figure 2B:
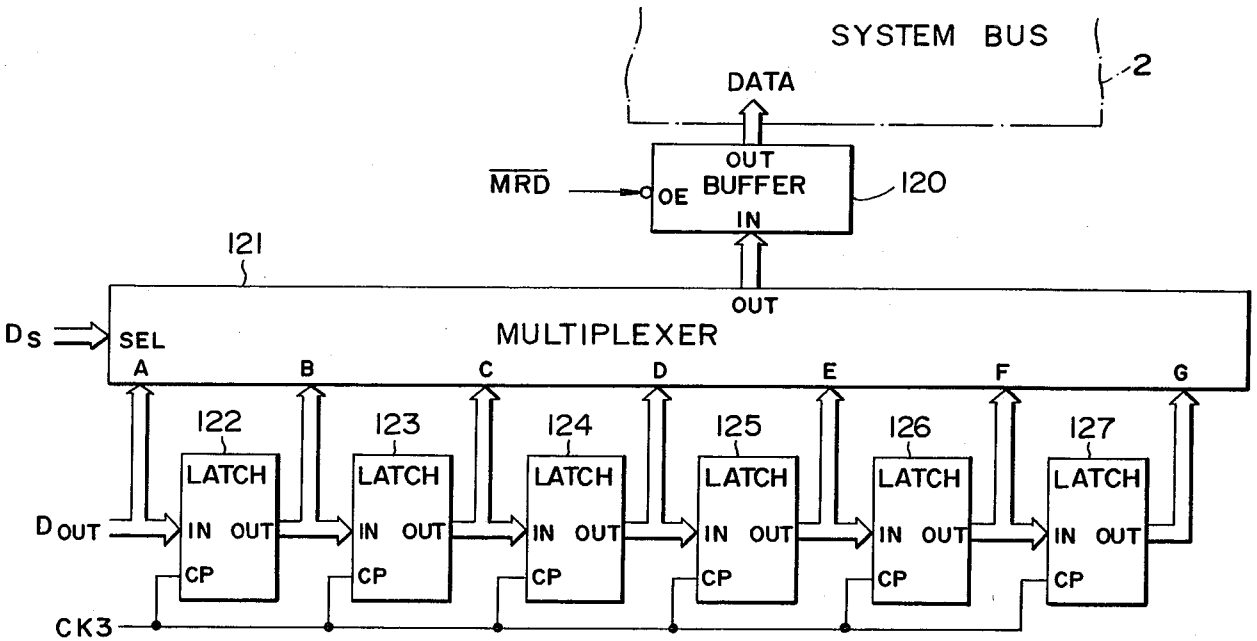
Figure 2C:
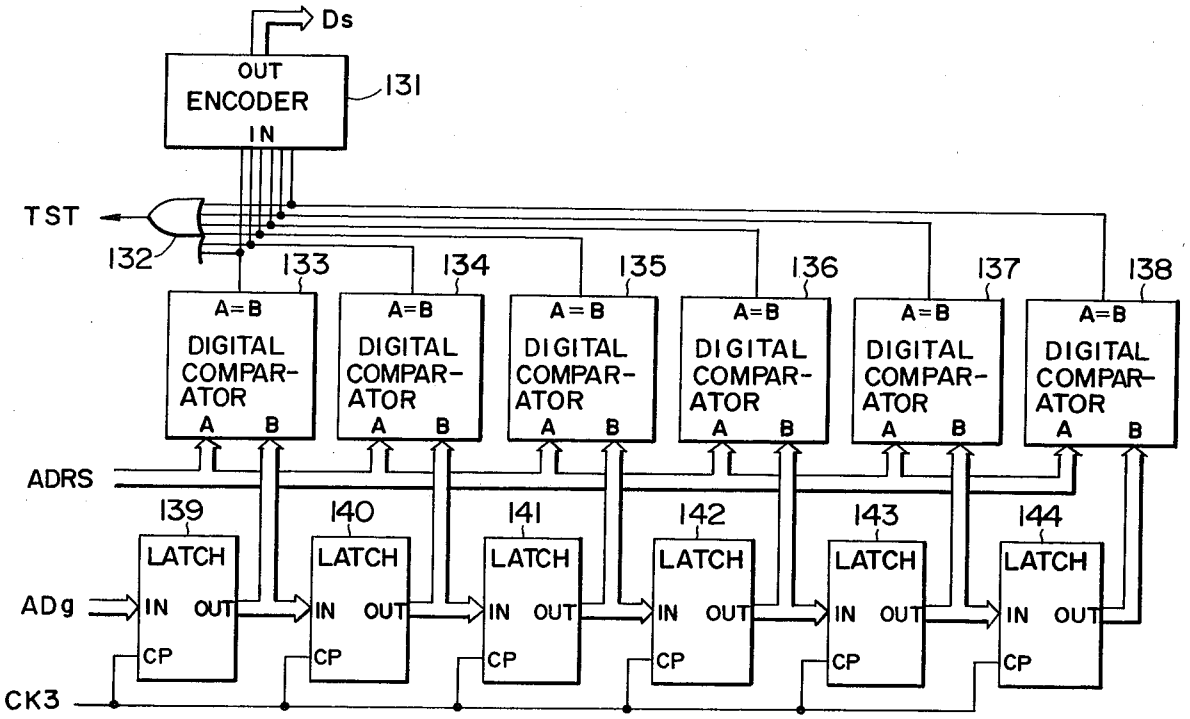
Figure 2D:
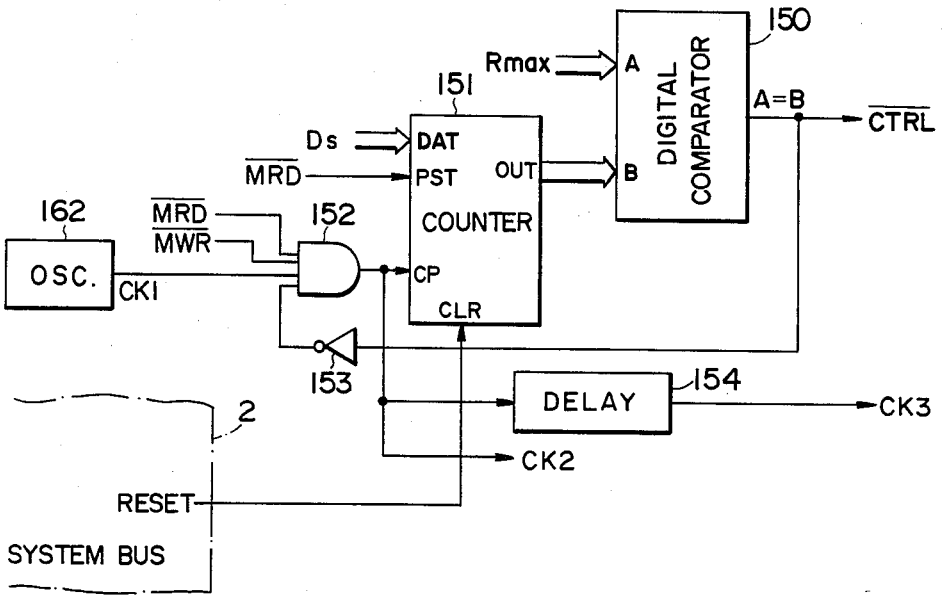
Figure 2E:
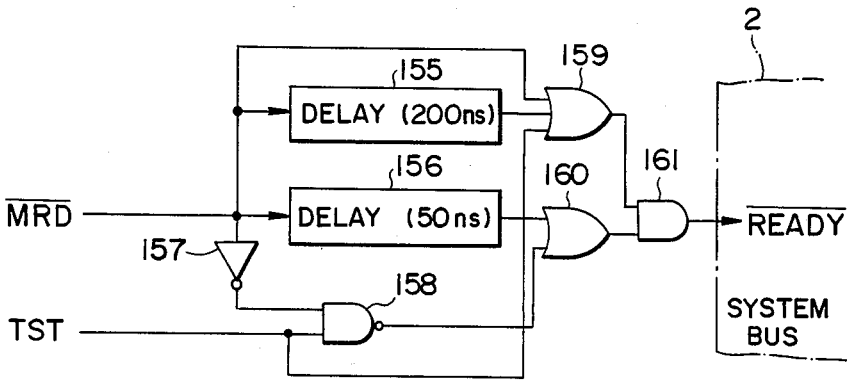
Figure 3:
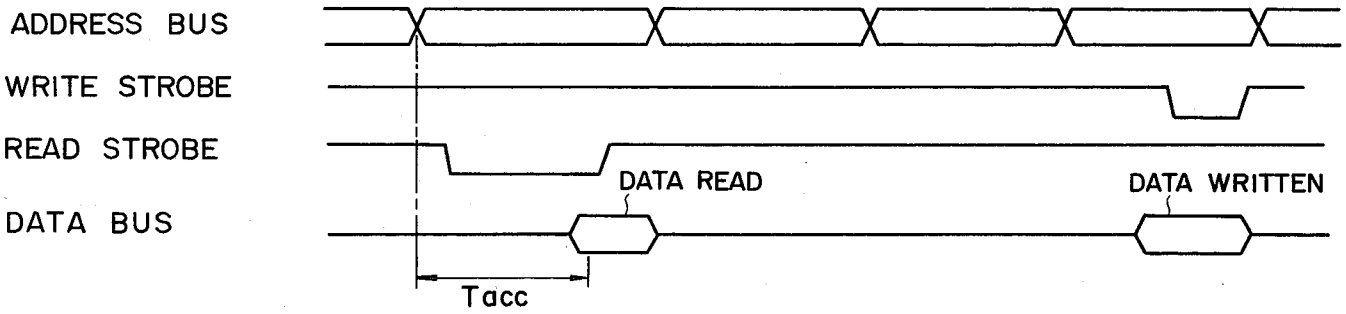
FIG. 3 is a timing chart representative of a composite copying operation which is performed by the copier of FIG. 1.
Figure 4A:
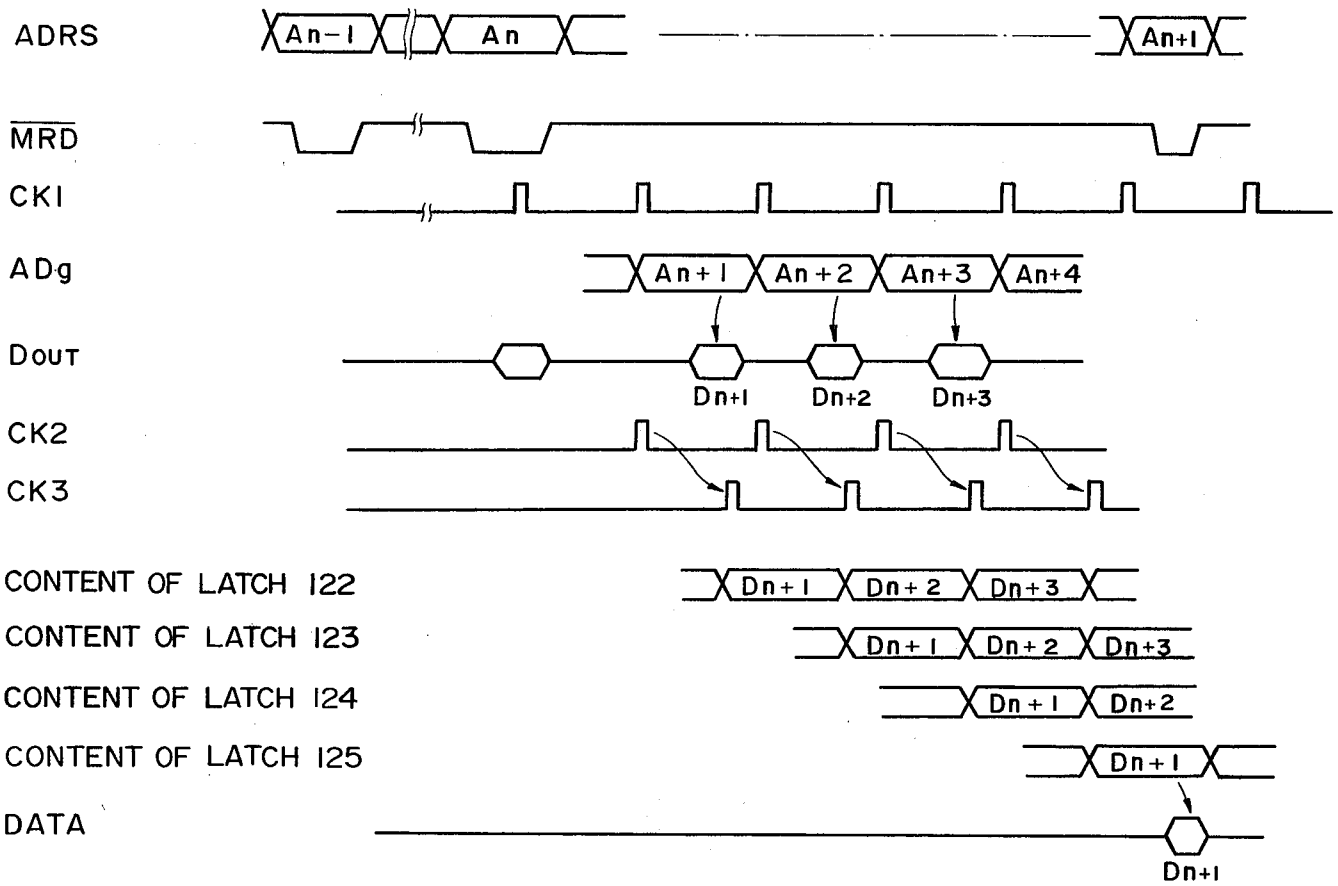
FIG. 4 is a flowchart demonstrating a sequence of manipulations which are performed on an operating section of the copier.
Figure 4B:
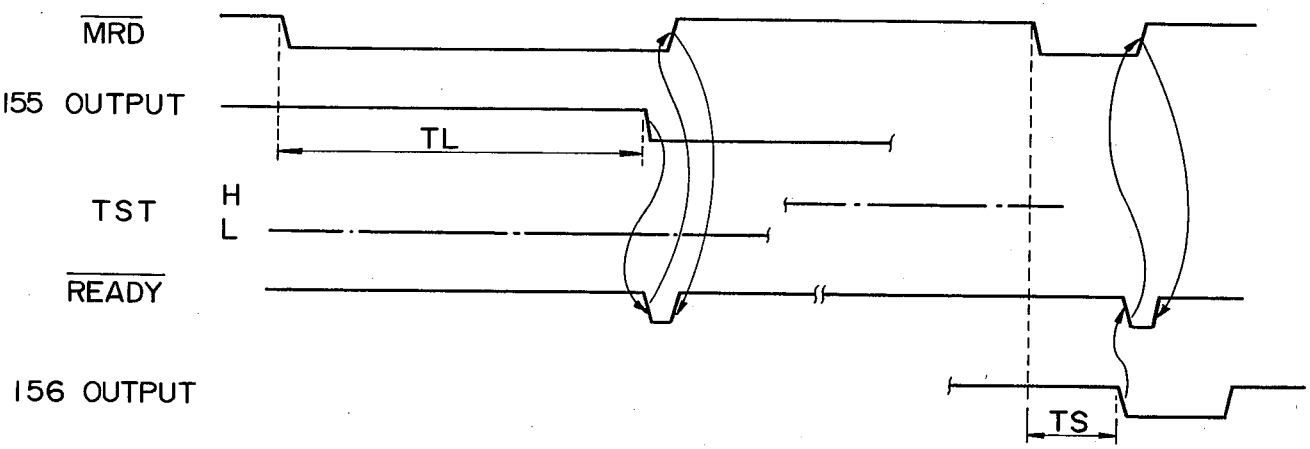
Figure 2:
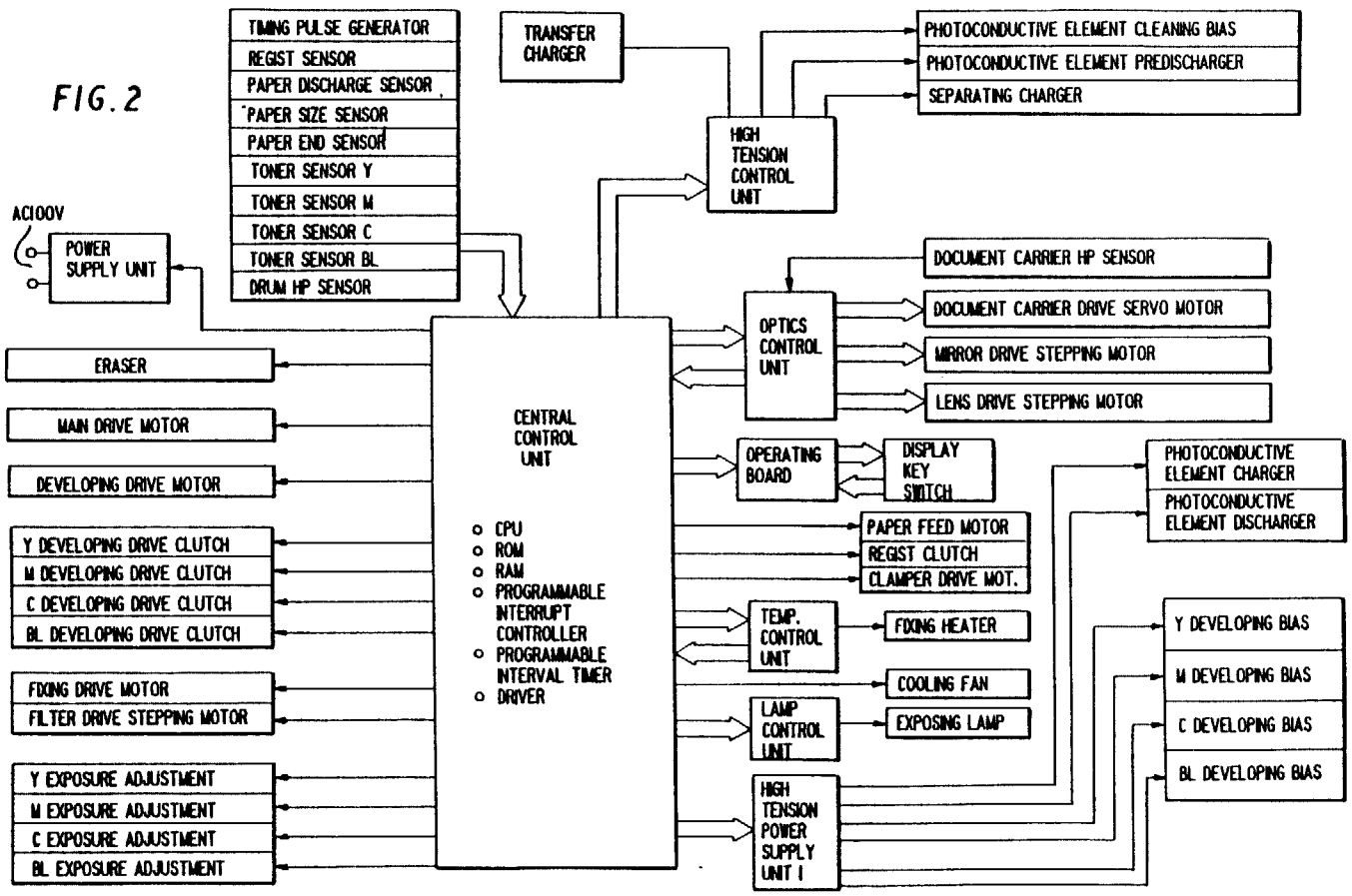
Figure 3:
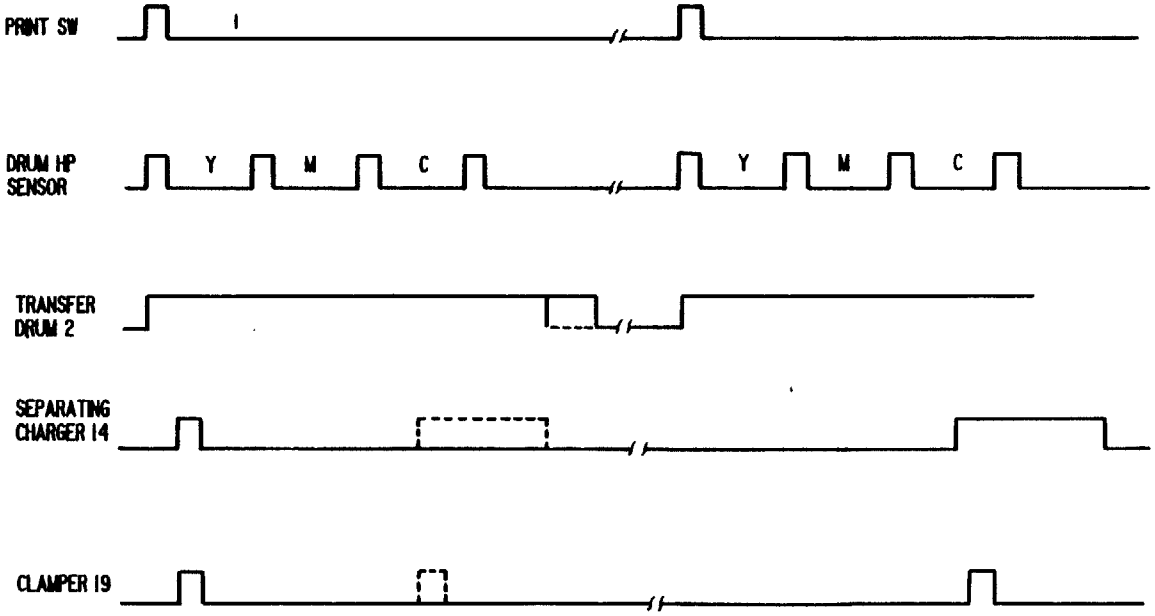

Referring to FIG. 1 of the drawings, there is shown a color copier in accordance with the present invention which employs the system with an extra black developer as stated above. A control system associated with this system is shown in FIG. 2, and a timing chart representative of a composite copying procedure in FIG. 3.

In FIG. 1, the color copier includes a photoconductive drum 1. A yellow developing unit 6, a magenta developing unit 7, a cyan developing unit 8, a black developing unit 9 and a transfer charger 12 are arranged one after another around the drum 1 in an intended direction of rotation of the drum 1 and at the downstream side of a predetermined exposing station. At a transferring station where the charger 12 is located, a transfer drum 2 having the same outside diameter as the drum 1 is disposed and held in contact with the drum 1. The drums 1 and 2 are rotatable in synchronism with and at the same peripheral speed as each other as indicated by arrows in the drawing.

Register rollers 21 are positioned in a path which extends from a feed roller 10 to a paper feed end 22 adjacent to the periphery of the transfer drum 2. The feed roller 10 make contact with the top of a stack of papers which are laid on a tray. A clamper 19 is provided on the periphery of the drum 2 to extend axially and over the entire width of the drum 2. Actuated by a cam or the like, the clamper 19 is opened at a position immediately before the paper feed end 22 and timed to the rotation of the register rollers 21 and closed at a position before the transferring station. Upon completion of a predetermined number of consecutive transfers, the clamper 19 is cammed or otherwise actuated to be opened. A charger 14 and a pawl 17 which constitute separator means in combination are located at the downstream side of the transferring station of the drum 2. At the end of a predetermined number of transfers, the charger 14 and pawl 17 are operated to separate from the drum 2 a paper to which toner images have been transferred a predetermined number of times. A belt 18 is adapted to convey the paper to a fixing unit, not shown.

A discharger 13, a cleaner 15, a discharger 16, a charger 3 and an eraser 4 are arranged in this order around the drum 1 downstream of the transferring station. The reference numeral 20 designates an optical imaging path into which four filters 5, i.e., a blue, a green, a red and a neutral density filters are selectively movable.

A full-color copy mode operation which the copier having the above construction may perform is as follows. The drum 1 is rotated three times while being exposed imagewise each time through the blue, green and red filters 5. The resultant latent images are respectively developed by yellow, magenta and cyan toners and each is transferred in a superposed relationship onto the same paper which is wrapped around the drum 2. Here, the prerequisite is that the three different colors, i.e., yellow, magenta and cyan be transferred in exact register on a paper so that the tints reproduced may appear the same as those of an original document. This in turn requires the paper to be prevented from becoming dislocated on the drum 2 during the course of operation.

The requirement as stated above is fulfilled by the clamper 19. Specifically, during the first rotation of the drum 1, the feed roller 10 feeds a paper in synchronism with the development which is performed by the yellow developing unit 6. Then, the paper is fed to the paper feed end 22 timed by the register rollers 21 and is stopped there. While the drum 2 is rotated in synchronism with the drum 1, the clamper 19 provided on the drum 2 is opened at a position before the paper feed end 22 and, as soon as it comes to face the paper feed end 22, the paper is fed by the register rollers 21 into the clamper 19. Thereafter, the clamper 19 is closed to surely clamps the leading end of the paper. As a result, the paper is transported to the transferring station while being clamped by the clamper 19 and electrostatically retained by the drum 2. The leading end of the paper registers with that of a toner image provided on the drum 1 at the transferring station, whereby the toner image is transferred onto the paper by the charger 12.

While the paper is rotated three consecutive times held in a predetermined position on the drum 2 by the clamper 19, toner images of three different colors, i.e., yellow, magenta and cyan are sequentially transferred onto the paper in a superposed relationship. When the transfer of the three toner images is completed, the clamper 19 is opened to unclamp the paper. At this instant, the charger 14 and pawl 17 are operated to separate the paper from the drum 2. Subsequently, the belt 18 transports the paper to a fixing unit where the paper is fixed to complete a full-color copy.

In a black-and-white copy mode or a single-color copy mode which uses either one of the yellow, magenta and cyan toners, the color copier exposes the drum 1 imagewise through a particular one of the filters 5, then deveops the resultant latent image by use of a single developing unit, and then transfers the resultant toner image to a paper. A prior art machine of the type described has effected such image transfer with the clamper 19 clamping the leading end of the paper, as has been the case with the full-color copy mode.

Figure 4:
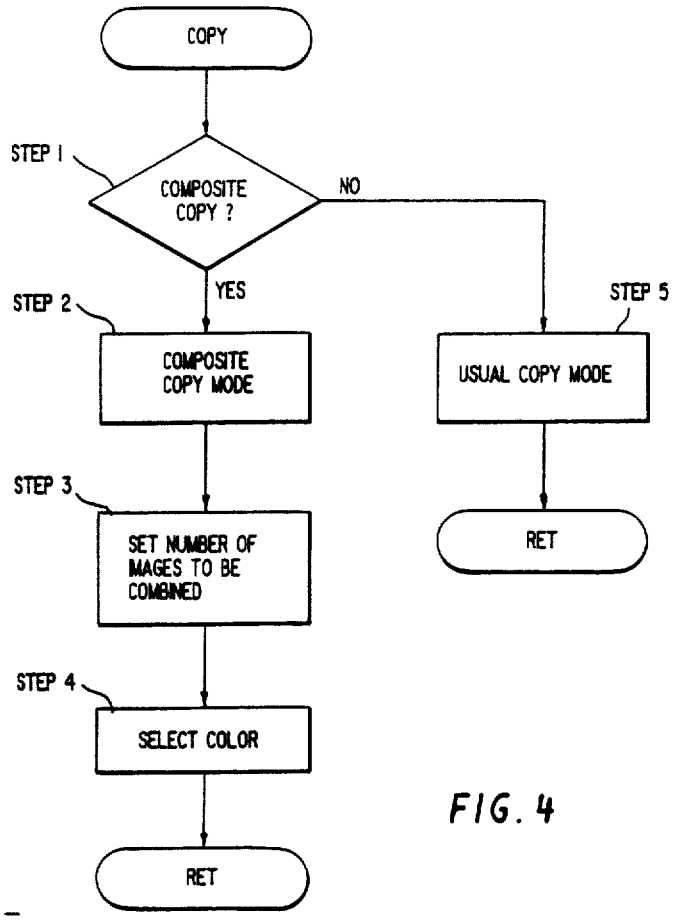
Figure 5:
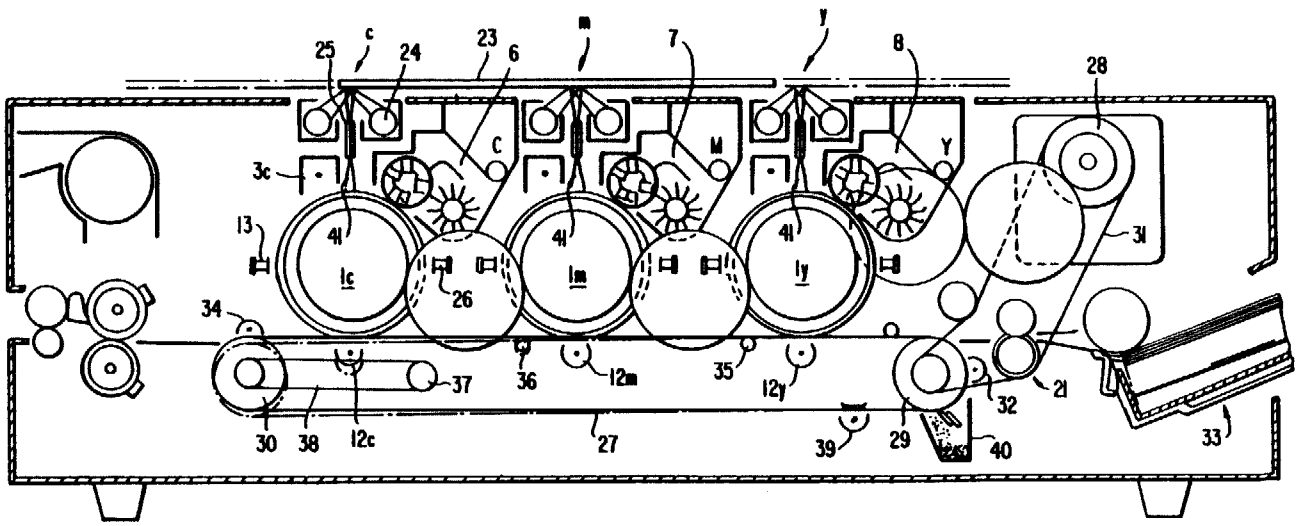

The copier is also capable of producing a composite copy by a procedure as represented by a flowchart in FIG. 4. As a composite copy key on an operating section of the copier is manipulated (STEP 1), a composite copy mode is selected (STEP 2). In this condition, numeral keys on the operating section are manipulated to enter the desired number of pictures which are to be combined on a single paper and which one of full-color copying and single-color copying is desired (STEP 4). Where a usual copy mode is selected, the procedure advances from the STEP 1 to a step 5, i.e. usual copy mode.

Assume that one desires to reproduce a composite image of two full-color images on a single paper. In this case, because the first image is copied by the usual copy mode and the second image by the composite copy mode, the operating section is manipulated to enter 1 (one) as the number of images to be combined with the first one, and full-color as color. Then, the process steps up to the first transfer occur in the same manner as in the prior art copier. However, in accordance with this particular embodiment, after the transfer of a three-color toner image the clamper 19 remains closed and the separating charger 14 and pawl 17 remain inoperative, with the result that the copier stops its operation with the paper wrapped around the transfer drum 2. Thereafter, the original document on a table of the copier is replaced with the second one (to be combined). Under this condition, a print switch is operated to cause the copier to enter into a usual copy mode operation. After a three-color toner image of the second document has been transferred to the paper, the clamper 19 on the drum 2 is opened so that the paper is separated from the drum 2 by the charger 14 and pawl 17 and, then, transported by the belt 18 to a fixing unit. This completes a composite copy of two different documents on a single paper.

As previously stated, images may readily be combined into a single composite copy even in the case of a single color and two colors merely by adequately selecting information to be entered as discussed above.

Among the process steps as described above, the number of images to be combined with the first one may be set by controlling the frequency and timing of operation of a clamper motor by way of the operating section. The color of a composite copy, too, may be selected by selectively actuating any one of the developing units by way of the operating section and such can be implemented by traditional technology.

Hereinafter will be described another type of color copier with which the method of the present invention may be practiced.

Figure 5:
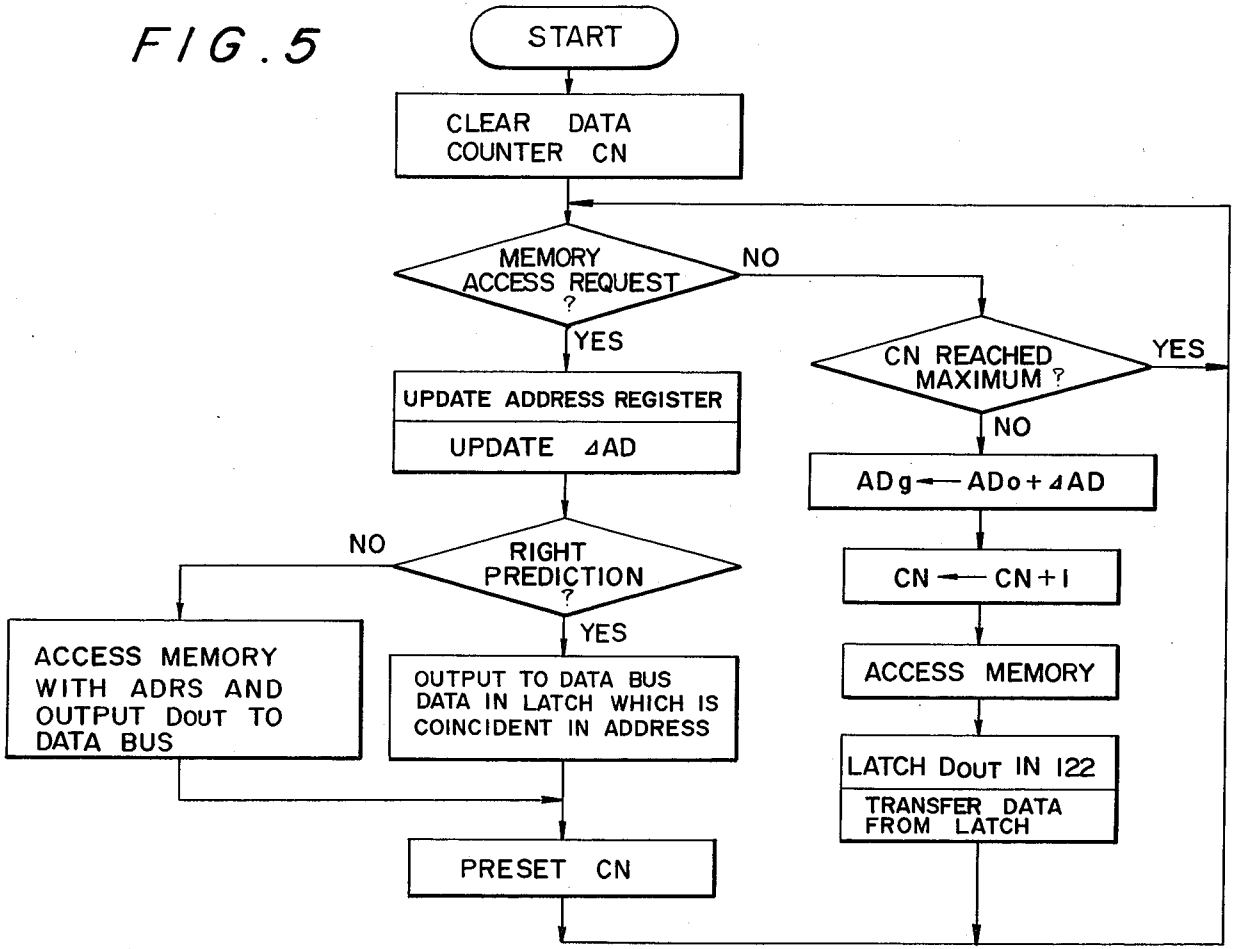
FIG. 5 is a schematic sectional side elevation of a color copier with which the method of the present invention may also be practiced.
Figure 1:
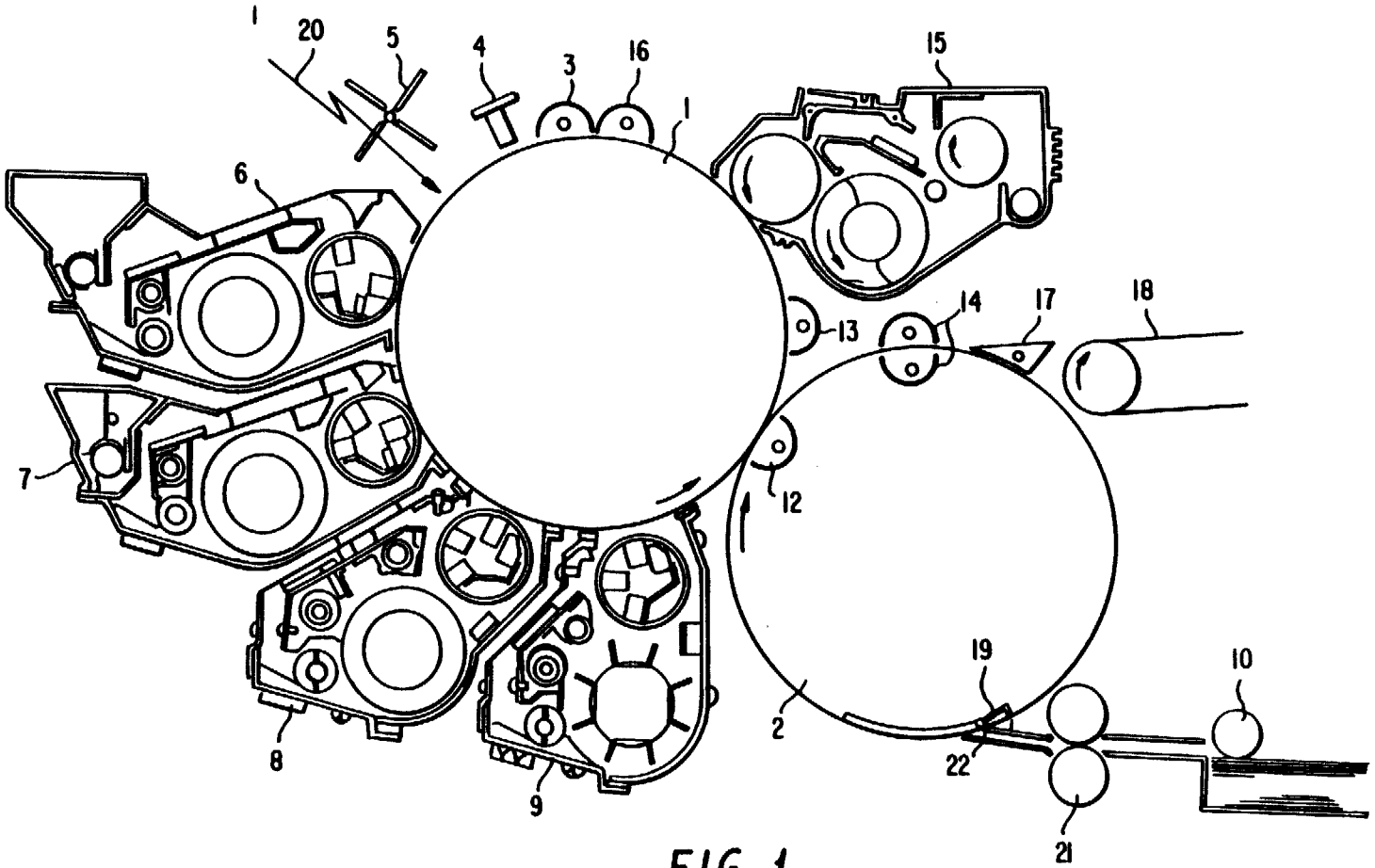
Figure 6:
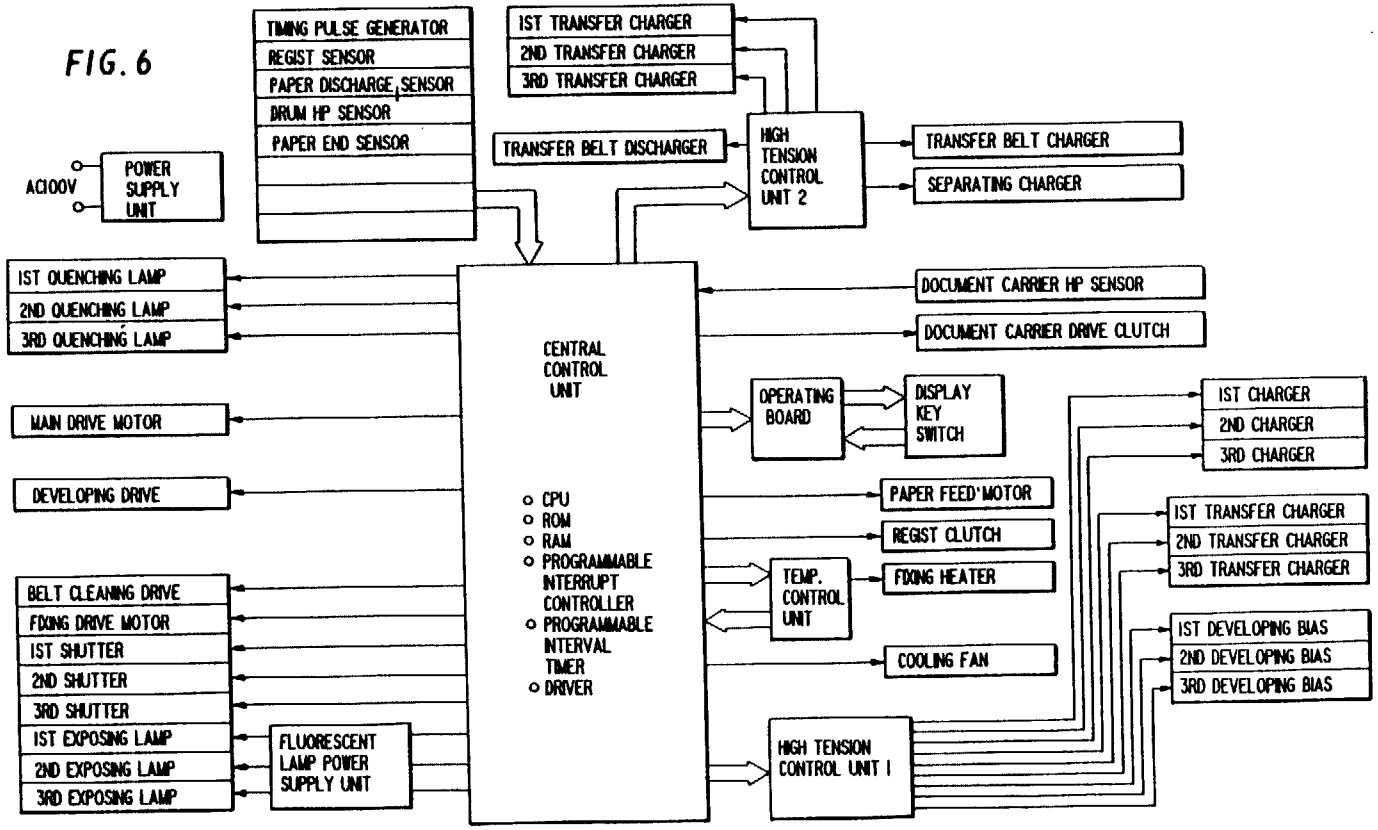
FIG. 6 is a block diagram showing a control system associated with the copier of FIG. 5.
Figure 7:
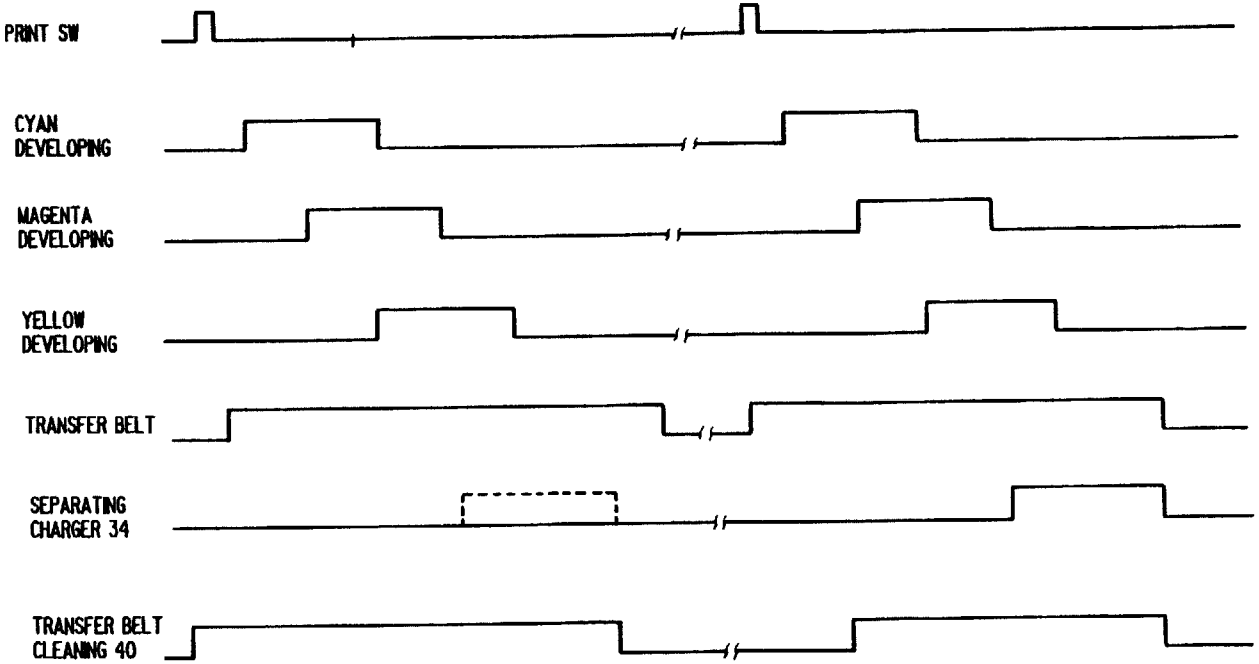
FIG. 7 is a timing chart representative of a composite copying operation as performed by the copier of FIG. 5.

FIG. 5 shows a color copier in a sectional side elevation, FIG. 6 a control system associated with the color copier, and FIG. 7 an operation of the color copier in a timing chart. In FIG. 5, the same or similar structural elements as those of FIG. 1 are designated by like reference numerals.

The color copier as shown in FIG. 5 comprises a serial arrangement of three independent electrophotographic devices which are assigned to development in, for example, cyan, magenta and yellow, respectively. As described later in detail, each of the electrophotographic devices includes an illuminating device, a lens arrangement, a photoconductive drum, a charger, a developing unit, a precharger, a transfer charger and a quenching lamp. A document laid on a movable table, or document carrier, of the copier is sequentially moved over the three electrophotographic devices to expose the photoconductive drum imagewise. This causes images separated in three colors to be formed one on each of the drums. The toner images provided on the respective drums are transferred sequentially and in the opposite order to a paper which is being transported by a belt in the opposite direction to the direction of illuminating stroke of the document carrier.

In the following description, the three photographic devices will be referred to as a first transfer station (cyan) c, a second transfer station (magenta) m, and a third transfer station (yellow) y according to the order of exposure to the document.

In FIG. 5, a document carrier 23 which is located on the top of the copier is moved from the left to the right as viewed in the drawing, causing an original document laid thereon to be illuminated. At each of the transfer stations, the drum is exposed imagewise to produce a color separated image which corresponds to the document. Subsequently, the document carrier 23 is returned to the original position, or home position, to be prepared for another illuminating stroke.

The first transfer station c comprises an illuminating device (red light) 24, a lens arrangement 25, a photoconductive drum 1*c*, a charger 3*c*, a cyan developing unit 6, a precharger (which may be replaced with optical discharging) 26, a transfer charger 12*c*, and a quenching lamp 13. As an original document is illuminated in red, a cyan toner image is formed on the drum 1*c*. The cyan toner image is transferred to a paper which is transported by a belt 27 (Myler film, 100 microns thick), which will be described. Thereafter, the quenching lamp 13 is energized to optically dissipate charge before transfer charging and, then, the charger 3*c* is activated to charge the drum 1*c* again, followed by the same procedure as described above. It is to be noted that the chargers and others which are needless before the transfer of a toner image from the drum 1*c* are held inoperative.

At the second transfer station m, the same procedure as the one occurred at the first transfer station c occurs except that the document is illuminated by green light and a magenta toner image is provided on a drum 1*m*. Further at the third station y, the document is illuminated by blue light and a yellow toner image is provided on a drum 1*y*.

The drums 1*c*, 1*m* and 1*y* have the same diameter D and are driven by a main motor 28 through a gearing. The nearby drums are spaced from each other by a distance which is one half the circumference of the drums, i.e. $\pi D/2$. Transfer chargers 12*c*, 12*m* and 12*y* are respectively disposed beneath the drums 1*c*, 1*m* and 1*y* with the intermediary of the belt 27 which makes contact with all of the three drums. The belt 27 serves to transport a paper in the opposite direction to the intended direction of illuminating stroke of the document carrier 23. The belt 27 is passed over rollers 29 and 30. The roller 29 is made of rubber and driven by the main motor 28 through a timing belt 31. A belt charger 32 is located adjacent to the outer periphery of the roller 29 to charge the belt 27 with the result that a paper which is fed from a tray 33 through register rollers 21 is electrostatically adhered to the belt 27. While the belt 27 is rotated, the paper on the belt 27 is moved along a path below the drums 1*c*, 1*m* and 1*y* so that toner images of different colors are transferred onto the paper by the respective transfer chargers. Finally, the paper is separated by a separator 34 and then driven toward a fixing unit. It is to be noted that the register rollers 21 are driven by the timing belt 31 in the same manner as the roller 29.

Auxiliary rollers 35 and 36 support the upper run of the belt 27 from below so as to prevent it from flexing downwardly. The roller 30 is mounted on one end of an arm 38 which is pivotted at the other end to a support shaft 37. This allows the roller 30 to be displaced downwardly together with the transfer charger 21*c* of the first transfer station c in order to prevent the belt 27 from making contact with the drum 1*c* except when the contact is required. Likewise, the auxiliary roller 36 is movable downwardly to in turn move the belt 27 clear of the drum 1*m* of the second transfer station m. The reference numeral 39 designates a discharger for discharging the belt 27, and 40 a cleaning unit.

In operation, the document carrier 23 with a document laid thereon is sequentially moved over the first to the third transfer stations c, m and y in this order and, then, returned to the home position to repeat the same movement. At first, the belt 27 is displaced to a position spaced from the drum 1*c* of the first station c by the downward movement of the arm 38 and auxiliary roller 36. At the first transfer station c, after the developing unit 6 has produced a cyan toner image on the drum 1*c*, the drum 1*c* is continuously rotated with the precharger 26, transfer charger 12*c*, quenching lamp 13 and charger 3*c* maintained inoperative.

Likewise, at the second transfer station m, the drum 1*m* is continuously rotated even after a magenta toner image has been produced thereon. In this instance, the auxiliary roller 36 and, therefore, the belt 27 is in the lowered position where it is spaced from the drum 1*m*.

At the instant when the leading end of the document has reached the third transfer station y, the register rollers 21 which are located at a distance of one half the length of the drum 1*y* from the drum 1*y* are driven to feed a paper to the belt 27. Then, the belt 27 moves with the paper electrostatically adhered thereto with the result that a yellow toner image provided on the drum 1*y* is transferred onto a predetermined position on the paper by the transfer charger 12*y*.

Immediately before the paper come out of the third transfer station y reaches the second transfer station m, the auxiliary roller 36 is raised to bring the paper into contact with the drum 1*m* so that a magenta toner image is transferred from the drum 1*m* to the paper from above the yellow image. Likewise, the paper arrived at the first transfer station c is moved into contact with the drum 1*c* by the upward movement of the transfer charger 12*c* and roller 30 which is caused by that of the arm 38. In this position, a cyan toner image is transferred by the transfer charger 12*c* onto the paper from above the magenta toner image. The paper with a composite color image thus completed is separated from the belt 27 by the separator 34 and roller 30 and, then, fixed by a fixing unit to become a composite color copy.

It will be understood from the above that the cyan toner image on the drum 1*c* is transferred to the paper during the third rotation of the drum 1*c*, i.e., after three times of development, the magenta toner image on the drum 1*m* is transferred to the paper after two times of development, and only the yellow toner image on the drum 1*y* is immediately transferred onto the paper.

It is to be noted that at each of the stations c, m and y the developing unit is cleaned after image transfer by switching a bias. Although several times of development occur in the stations c and y, such is no problem only if the developing conditions are set up adequately. At each of the stations y and m, on the other hand, several times of cleaning occur. Each of the stations c, m and y further includes a shutter 41 which is provided in the exposing device and closed except when it should be opened in order to eliminate re-exposure of the drum, which is continuously rotated a plurality of times with the toner image deposited thereon.

In the copier constructed as described above, a composite copy mode is selected by manipulating a composite copy key on an operating section of the copier. Then, the copier enters into the composite copy mode as shown in the flowchart of FIG. 4. In this particular mode operation, the operating section is manipulated to enter the number of images to be combined with the first as well as color (single color or full-color). Assume that one desires to combine a full-color image and black characters into a single composite copy while converting the black characters into magenta characters. In this case, the full-color image will be copied in a usual mode and, then, the black characters will be combined with the full-color image after being converted into magenta characters, so that the operator enters 1 (one) as the number of images to be combined with the first one and magenta as the color. When a print switch is turned on with an original document laid on the document carrier 23, it is copied in a usual full-color mode at first. Under this condition, the separator 34 remains inoperative to allow a paper electrostatically adhered to the belt 27 to be continuously transported without being separated from the belt 27. In the meantime, the discharger 39 is not energized or applies to the belt 27 a charge of such a degree which does not separate the paper from the belt 27. In the cleaning unit 40, a blade is moved away from the belt 27 by a solenoid. Further, the charger 32 is turned off, the transfer charger 12*y* at the third station y is turned off to prevent the yellow toner from adhering to the paper, and the second station m performs a usual copy mode operation to transfer the magenta toner onto the paper which has undergone the full-color copying process.

The first station c is conditioned in the same manner as the third station so as not to transfer the cyan toner to the paper. Thereafter, the separator 34 is activated to separate the paper from the belt 27 while the belt 27 transports the paper to the fixing unit, as in a usual copy mode. The paper is fixed at the fixing unit to complete a composite copy which consists of a full-color image and magenta characters.

While this particular embodiment has been shown and described in relation to a single-color composite copy, it is capable of readily producing even a composite copy in full colors by the same procedure. The rest of construction and operation will be easily understood from those of the embodiment of FIG. 1 as previously discussed.

In summary, it will be seen that in accordance with the present invention a composite copy producing process in a color copier is implemented without the need for a stacker, preventing the whole copier from becoming bulky. This leads to a cutdown of costs as well.

Various modifications will become possible for those skilled in the art after receiving the teachings of the present disclosure without departing from the scope thereof.

What is claimed is:

1. A color copier capable of producing a composite copy, comprising:

at least one rotatable photoconductive element;

exposing means for exposing said photoconductive element imagewise via filter means to provide on said photoconductive element at least one latent image each of which corresponds to at least one original document;

developing means comprising at least a yellow developing unit, a magenta developing unit and a cyan developing unit for developing each of said at least one latent image with toners;

means for selecting a predetermined number of said at least one original document to be combined on a paper and outputting a signal indicating said number;

paper support means for supporting said paper such that toner images provide by said developing means on said photoconductive element are transferred onto a predetermined position on said paper superposed on and in register with each other;

paper separator means for separating said paper from said paper support means after completion of transfer of the toner images; and control means responsive to the output of said means for selecting in order to control the operation of said paper separator means such that the paper is separated at any selected timing in accordance with said means for selecting.

2. A color copier as claimed in claim 1, wherein said developing means further comprises a black developing unit.

3. A color copier as claimed in claim 2, wherein said filter means comprises a blue, a green and a red color separating filters and a neutral density filter.

4. A color copier as claimed in claim 1, wherein said paper support means comprises a transfer drum around which the paper is to be wrapped, a clamper mounted on said transfer drum for supporting the paper which is wrapped around said transfer drum, and a transfer charger located in a transferring position of said transfer drum.

5. A color copier as claimed in claim 4, wherein said paper separator means comprises a charger located in a separating position of said transfer drum, and a pawl for separating the paper.

6. A color copier as claimed in claim 1, wherein said paper support means comprises a belt on which the paper is to be laid, a charger for retaining the paper on said belt, and a charger for separating the paper from said belt.

7. A composite copying method for a color copier which is capable of selectively producing single-color copies and full-color copies or any combination of said single color copies and said full color copies, comprising the steps of:

(a) selecting a composite copy mode to be utilized;

(b) setting a number of a images to be combined with a first image on a single paper;

(c) selecting one of full-color copying and single-color copying for each of said number of images and for said first image; and (d) feeding originals corresponding to said first image and said set number of images whereby a composite copy is produced on said single paper having a copied number of images equal to said set number plus said first image.

* * * * *

UNITED STATES PATENT AND TRADEMARK OFFICE

CERTIFICATE OF CORRECTION

PATENT NO. : 4,750,017

DATED : Jun. 7, 1988

INVENTOR(S) : Yoshihiro SAKAI

It is certified that error appears in the above-identified patent and that said Letters Patent is hereby corrected as shown below:

The drawings printed in the Patent are incorrect. The attached seven (7) sheets should be substituted for the nine (9) sheets printed in the Patent.

The title page should be deleted to appear as per attached title page.

Title page, "7 Claims, 9 Drawing Sheets" should read
--7 Claims, 7 Drawing Figures--

Signed and Sealed this

Tenth Day of January, 1989

*Attest:*

DONALD J. QUIGG

*Attesting Officer*

*Commissioner of Patents and Trademarks*

United States Patent [19]

Sakai

[11] Patent Number: 4,750,017

[45] Date of Patent: Jun. 7, 1988

[54] COMPOSITE COPYING METHOD AND COLOR COPIER FOR PRACTICING THE SAME

[75] Inventor: Yoshihiro Sakai, Tokyo, Japan

[73] Assignee: Ricoh Company, Ltd., Tokyo, Japan

[21] Appl. No.: 893,774

[22] Filed: Aug. 6, 1986

[30] Foreign Application Priority Data

Aug. 13, 1985 [JP] Japan ..... 60-176949

[51] Int. Cl.[4] ..... G03G 15/01

[52] U.S. Cl. ..... 355/4; 355/3 SH; 355/3 R

[58] Field of Search ..... 355/4, 3 R, 3 SH, 14 SH, 355/14 R

[56] References Cited

U.S. PATENT DOCUMENTS

| | | | |
|---|---|---|---|
| 4,072,412 | 2/1978 | Suda et al. | 355/4 X |
| 4,095,879 | 6/1978 | Katayama et al. | 355/4 |
| 4,531,828 | 7/1985 | Hoshino | 355/4 X |

*Primary Examiner*—A. C. Prescott

*Attorney, Agent, or Firm*—Oblon, Fisher, Spivak, McClelland & Maier

[57] ABSTRACT

A composite copying method in full colors, a single color, two colors and black and white and a color copier for practicing the method are disclosed. While toner images of different colors are sequentially transferred onto a paper, the paper is retained by a support member. The timing at which the paper is to be separated from the support member is controllable from outside the copier.

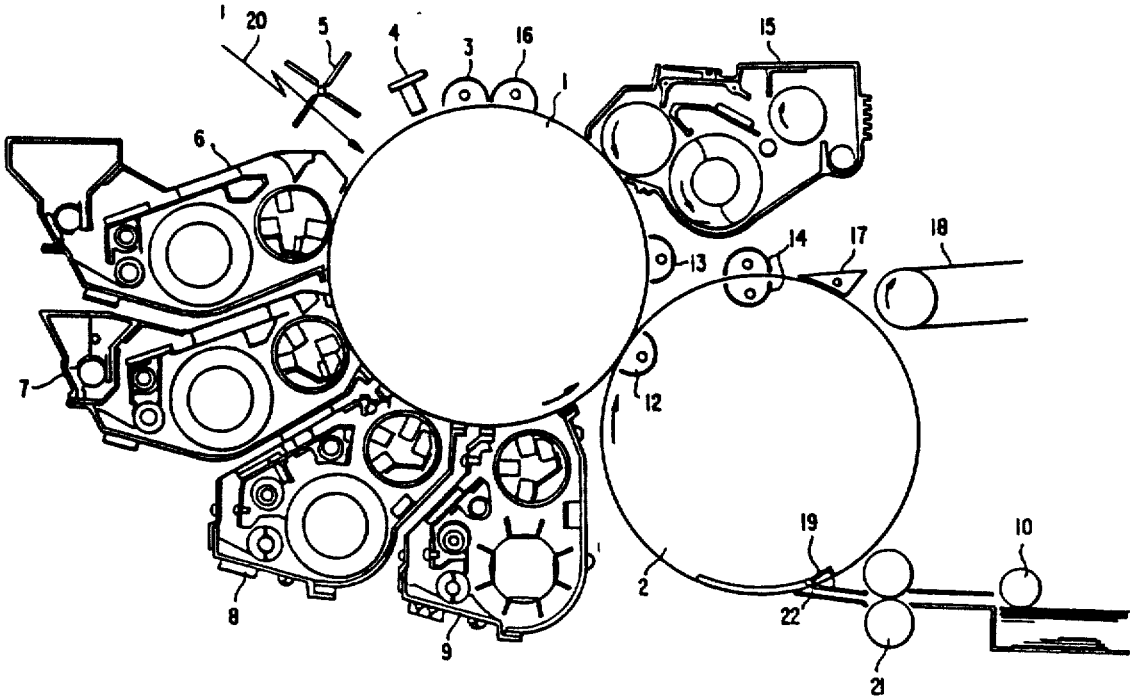

7 Claims, 9 Drawing Sheets